United States Patent [19]

Stupay

[11] 4,195,893

[45] Apr. 1, 1980

[54] FLAT RIBBON CABLE MASS TERMINATION CONNECTOR ASSEMBLY

[75] Inventor: Lawrence J. Stupay, Endwell, N.Y.

[73] Assignee: Bunker Ramo Corporation, Oak Brook, Ill.

[21] Appl. No.: 930,484

[22] Filed: Aug. 2, 1978

[51] Int. Cl.[2] ..... H01R 3/06

[52] U.S. Cl. ..... 339/14 R; 339/17 F; 339/275 R; 29/867; 29/828

[58] Field of Search ..... 339/14 R, 17 F, 275 R; 29/629

[56] References Cited

U.S. PATENT DOCUMENTS 4,005,921 2/1977 Hadden et al. ..... 339/14 R

*Primary Examiner*—Roy Lake
*Assistant Examiner*—DeWalden W. Jones
*Attorney, Agent, or Firm*—F. M. Arbuckle; T. J. Haller

[57] ABSTRACT

A method and assembly are disclosed for terminating a plurality of signal and ground or shield conductors of a ribbon cable. The assembly includes a contact plate having a plurality of termination tabs each joined to a carrier strip and a ground member. The active signal conductors of the cable are electrically connected to each of the tabs while the ground conductors are connected to the ground member. The terminated cable is then insert molded in an integral dielectric housing, leaving only the carrier strip and portions of the termination tabs and ground member exposed. The carrier strip is then severed from the connector, thereby electrically isolating the termination tabs from each other and the ground member. The resulting connector is mechanically and electrically reliable and may be interfaced with compatible electrical components without damage to the individual terminations.

17 Claims, 6 Drawing Figures

FIG. 1
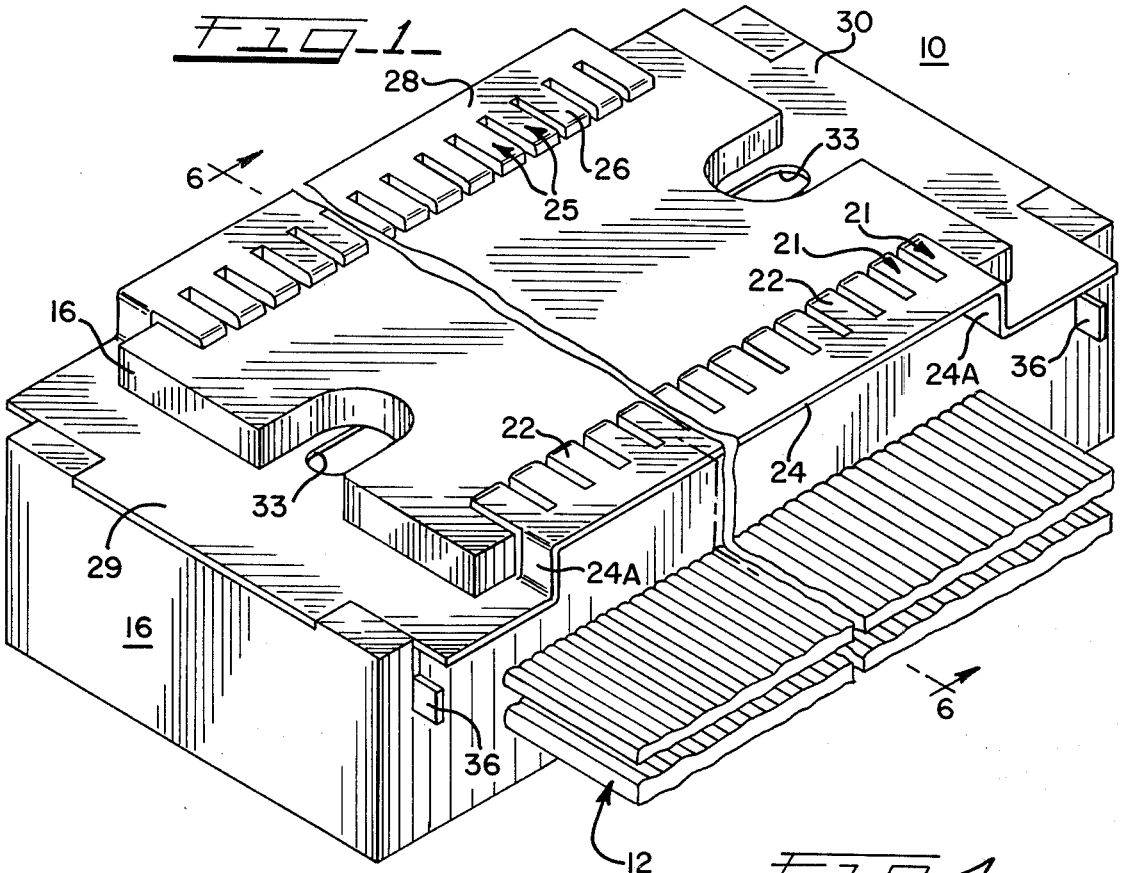
FIG. 4
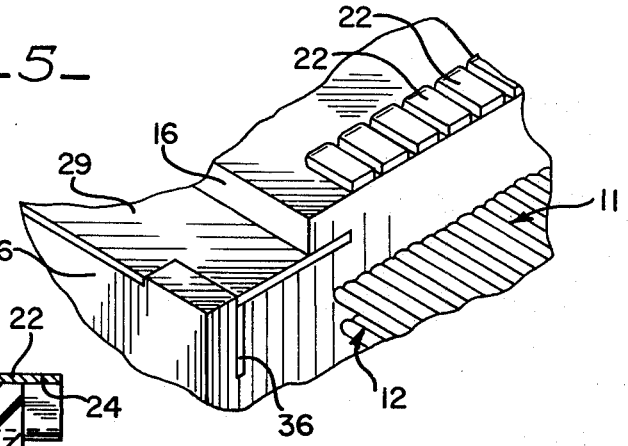
FIG. 5
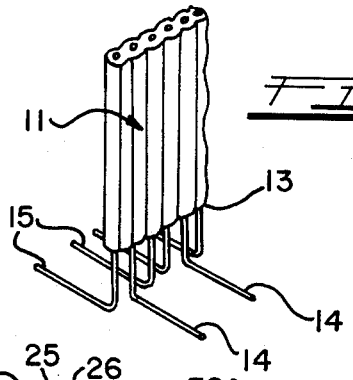
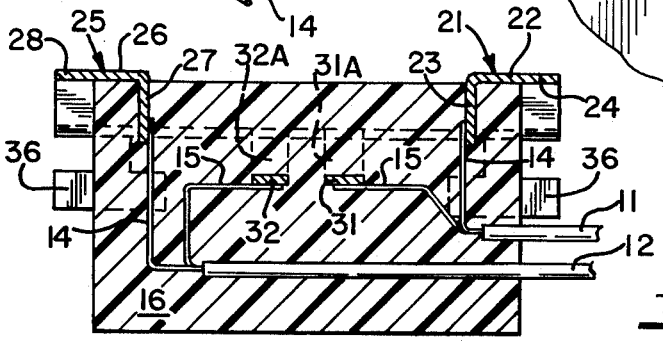
FIG. 6

FLAT RIBBON CABLE MASS TERMINATION CONNECTOR ASSEMBLY

BACKGROUND OF THE INVENTION

The invention relates to an electrical connector for ribbon cable and a method of terminating that cable whereby the cable may be ultimately connected to other electrical components. More particularly, the invention relates to a novel method and structure for providing termination of ribbon cable.

"Ribbon" or "flat" cable is electrical cable in which many conductors are embedded in a common sheath of flat ribbonlike insulative material. The conductors are generally arranged in parallel, side-by-side relationship in a single layer. Reduction in the dimensions of ribbon cable to accommodate the recently miniaturized components of computers and other electronic equipment has increased the difficulties in assuring the fixed and reliable connection of the cable to the equipment. One reason the cable is difficult to terminate is that there is little space between adjacent conductors in the cable. Typically, the individual conductors are spaced at 0.050 centers and sometimes even closer spacings. Moreover, the small size and fragility of each conductor introduces mechanical problems in positioning and supporting those individual conductors during manipulation of the connector. In addition, conventional ribbon cable includes both signal bearing conductors and ground or shield conductors. The connector used to terminate the cable thus becomes additionally complicated by the necessity of having ground means to carry stray signals transmitted to the shield or ground conductors.

SUMMARY OF THE INVENTION

The present invention is directed to an integral electrical connector for terminating one, or a pair of ribbon cables, and a method of making such a connector.

More particularly, an important feature of the present invention is the provision of a low-cost integral electrical connector for ribbon cable which is easily manufactured and yet provides a strong and easily assembled termination for such cable.

An important feature of the present invention is the use of a simple stamped electrically conductive contact assembly which, after termination with the associated ribbon cable, can be simply encapsulated and thereafter trimmed to provide a unitary integral connector. A novel feature of the connector plate is the use of spaced contact termination tabs which are joined by an interconnection carrier strip, which is severed from the connector leaving the contact termination tabs individually spaced and individually connected to their respective signal conductors.

The contact assembly comprises a one-piece electrically conductive metal plate formed to provide at least one array of active contact elements. Preferably, first and second arrays comprising spaced contact termination tabs are provided, each disposed on opposite edges of the plate, the tabs being connected by first and second common interconnection carrier strips. A ground contact element is disposed between the first and second arrays of contact termination tabs and is connected therewith by the common interconnection carrier strips. Each termination tab is generally L-shaped and one leg of the L is connected to the carrier strip. After encapsulation, the carrier strips are removed, leaving the tabs exposed for contact with some other electrically conductive member, but separated from one another and the ground contact element.

BRIEF DESCRIPTION OF THE DRAWINGS

The features of the present invention which are believed to be novel are set forth with particularity in the appended claims. However, the invention, together with other objects and advantages thereof, may best be understood by reference to the following description, taken in connection with the accompanying drawings, in which:

FIG. 1 is an enlarged perspective view of an electrical connector terminating a pair of ribbon cables and constructed in accordance with and embodying the features of the present invention and illustrated at an intermediate stage of manufacture;

FIG. 4 is a portion of the connector of FIG. 1 contained within the area encompassed by the circle in FIG. 1, and illustrating the configuration of the parts as finally assembled after the carrier strip of the connector plate is removed;

FIG. 5 is a perspective fragmentary view of a typical ribbon cable with which the present invention can be used and illustrating the various conductors formed for attachment to the contact assembly illustrated in FIGS. 2 and 3; and FIG. 6 is a fragmentary sectional view of the connector of FIG. 1, taken along line 6—6 of FIG. 1, and showing the relationship of the various parts prior to removal of the common carrier strips of the connector plate.

DESCRIPTION OF THE PREFERRED EMBODIMENT

Figure 2:
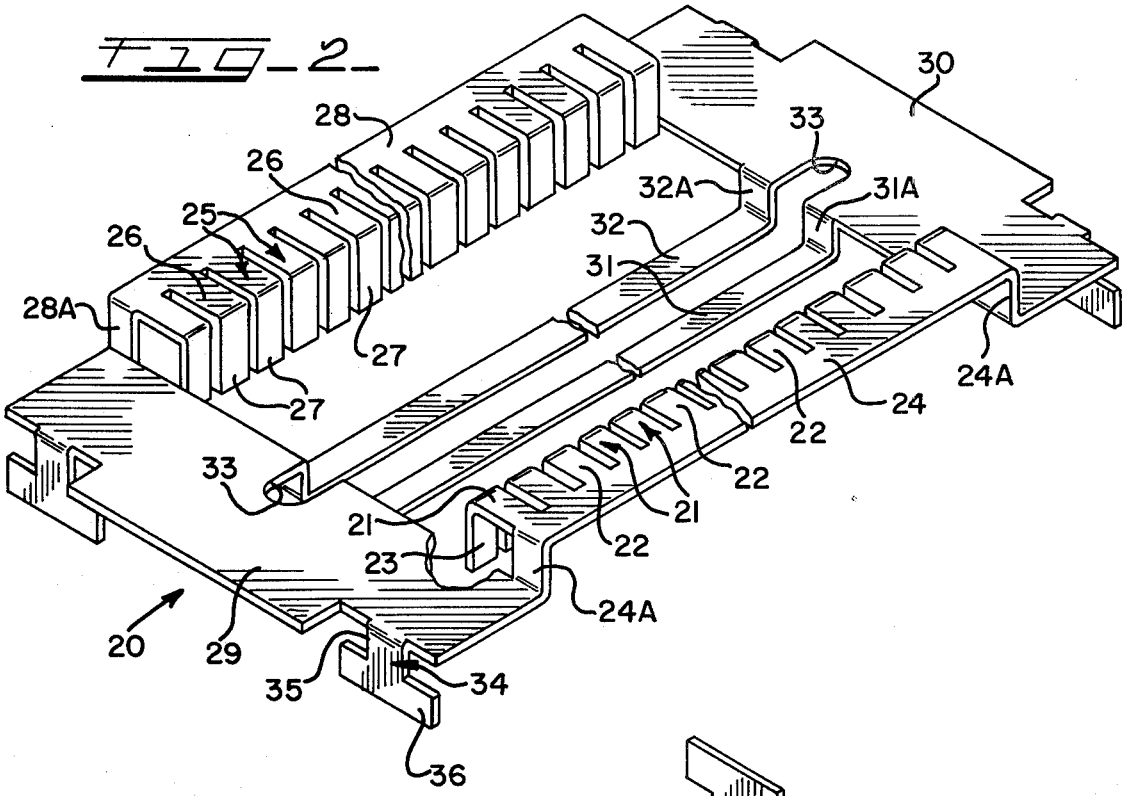
FIG. 2 is a perspective view of the contact assembly utilized in manufacturing the connector illustrated in FIG. 1, in the same relative position as illustrated in FIG. 1 prior to connection to the associated ribbon cables and encapsulation.

Illustrated in the drawings, and in particular in FIG. 1, is an electrical connector designated generally by the numeral 10 and constructed in accordance with the present invention, having securely affixed therein a pair of ribbon cables 11 and 12. The connector 10 consists of a contact assembly plate 20 (FIGS. 2 and 3) to which the conductors of the ribbon cables 11 and 12 are terminated, as more completely described hereinafter, and after which the unit is potted or encapsulated with an electrically insulative material so as to provide the configuration illustrated in FIG. 1.

The ribbon cables each consist of a group of insulated electrical conductors disposed in substantially parallel, side-by-side relationship. The conductors are generally of a copper or other highly conductive wire, as is well known in the art, and, as is frequently the case, adjacent signal conductors such as 14 (FIG. 5) are separated by ground or shield conductors designated generally by the numeral 15, to thereby isolate the signal conductors 14 and provide means for grounding stray signals.

Figure 3:
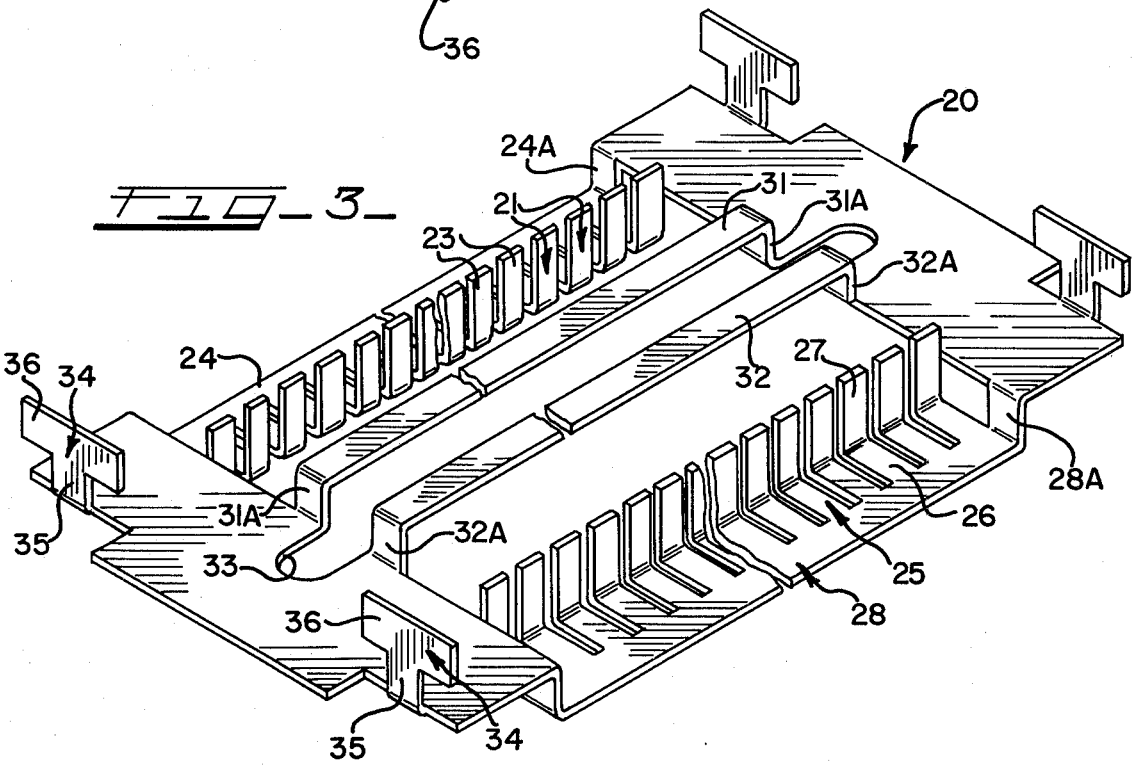
FIG. 3 is a bottom perspective view of the connector plate of FIG. 2.

The contact assembly plate 20 preferably is formed by conventional stamping and forming techniques from sheet stock of electrically conductive metal, as is best seen in FIGS. 2 and 3, and includes a first row or parallel array of spaced contact termination tabs designated generally by the numeral 21. Each termination tab 21 is generally L-shaped in configuration, with one leg 22 of the L being disposed in a plane above the plane of the plate 20 and generally parallel thereto, with the second leg 23 of the L being disposed substantially normal to the plane of the plate 20. Each tab 21 is connected at the outside end of the first leg 22 to a carrier strip 24, whereby all of the tabs 21 of the array are interconnected. The strip 24 in turn is carried by the plate 20 by means of the upwardly extending legs 24A, which are formed when the plate 20 is stamped.

The legs 23 of each tab 21 are generally greater in length than the connecting legs 24A by which the carrier strip is secured to the plate, and thus each leg 23 extends below the plane of the plate as defined by the edge strips 29 and 30.

Disposed on the opposite side of the plate is a second parallel array of spaced contact termination tabs 25 which are mirror images of, and identically arranged to the first tabs 21, each tab 25 including a first leg 26 parallel to the plane of the plate and spaced thereabove and a second leg 27 extending normal thereto. Each tab 25 is integrally formed and connected to a common interconnection strip 28 whereby all of the tabs 25 are carried by the strip 28 in a common position relative to the plane of the plate as defined by the edges 29 and 30. The carrier strip 28 is joined to the edge plates 29 and 30 by means of the formed legs 28A extending upwardly out of the plane of the edge strips. The two edge strips thus interconnect the two parallel arrays of contact tabs.

Disposed approximately midway between the edge plates 29 and 30 is a first common ground member 31 positioned adjacent the first array of contact tabs 21, and a second common ground member 32 disposed adjacent to the second array of tabs 25. Each common ground member 31 and 32 consists of a generally flat elongated metal member integrally formed as part of the plate and extending downwardly below the plane of the plate as defined by the edge plates 29 and 30, and being connected thereto by the integrally formed legs 31A and 32A respectively. The dimension of the legs 31A and 32A is slightly greater than the distance by which the legs 23 and 27 of the respective tabs extend below the plane of the plates 29 and 30.

To complete the description of the contact assembly plate 20, it will be observed that integrally formed on the outside of the edge plates 29 and 30 are pairs of retention tabs 34, each tab 34 being generally T-shaped in configuration, with the vertical leg 35 of the T depending downwardly from the edge plates and the cross leg 36 of the T extending in a plane normal to the plane of the respective edge plate. The retention tabs serve to secure the connector plate 20 in the encapsulating material during the potting operation. Finally, each edge strip 29 and 30 includes a generally semicylindrical aperture 33 formed therein, whereby, if desired, contact may be made with the ground plate by means of a screw or the like passing through the encapsulation, as best seen in FIG. 1.

The unique method of terminating the electrical ribbon cable to provide the integral connector, forming part of the present invention, will now be described. The ribbon cables are stripped at the ends by removing the insulation therefrom for a predetermined distance, and particularly leaving exposed the distal end of each of the conductors of the group contained within the cable, as best illustrated in FIG. 5. The signal conductors 14 are then formed into a first parallel array substantially normal to the longitudinal axis of the cable 11. The exposed shield conductors 15, alternately arranged with the signal conductors, are formed into a second parallel array, also substantially normal to the direction of the cable 11 and extending in a direction opposite to the first array of conductors 14. The cable is then positioned relative to the first array of contact termination tabs such that the bent portion of the conductors 14 abut the legs 23 of the tabs 21. The conductors 14 are then fixedly and electrically connected to the respective tabs 21 by soldering.

The cable 11 is then rotated approximately 90° such that the shield conductors 15 engage the bottom surface 31A of the first common ground member 31. Those shield 15 conductors are also permanently affixed to the common ground 31 by soldering. Where it is desirable to have a second ribbon cable such as 12 affixed to the same contact assembly plate 20, substantially the same procedure is followed with the conductors 14 and 15 being formed at right angles to the cable for securement to the respective legs of the contact tabs 27 and the surface 32A of the second common ground member 32. In order to facilitate such attachment, it should be observed that cable 12 is bent over 180° after securement to the plate, whereby both cables will be disposed in the same direction relative to the plate 20.

The connector plate and cables after soldering are then ready for potting or a molding process in which a thermosetting insulative plastic resin such as G.E. Valox is molded about the first and second arrays of conductors and the common ground members, leaving exposed only the edge plates 29 and 30, the legs 22 and 26, respectively, of the tabs and the carrier strips 24 and 28. Thus, the connector will be in the intermediate fabrication stage illustrated in FIGS. 1 and 6. In order then to isolate the individual contact termination tabs 22 and 26 relative to one another and to the other signal conductors, and to electrically isolate the signal conductors from the ground plate and ground members 31 and 32, the carrier strips 24 and 28 are milled off. By thus removing the carrier strip between each adjacent leg 22 and 26, each contact tab will be effectively electrically isolated from the adjacent tabs and from the ground members, as best seen in FIG. 4. This milling operation may also serve to remove the excess portion of the retention tabs 36 which extend beyond the body of the insulative material 16 after molding.

If desirable, in order to increase the electrical conductivity of the signal circuits connected through the respective tabs, those tabs may be coated with a highly conductive material such as gold or the like.

While plate 20 has been illustrated with two separate ground members 31 and 32, it should of course be understood that a single member could be utilized for receiving the shield conductors of both cables, if desired.

The finished connector 10 thus consists of a one piece mold dielectric housing 16 encapsulating both the tabs 21 and 25 and ground members 31 and 32, and a portion of the insulated cables 11 and 12. This thus provides a strong connection with the cables whereby the cable and connector can be grasped and utilized while minimizing possible damage to the conductors and ruining the electrical connection between the conductors and the respective elements of the connector. The simplicity of the device renders it easy to mold and to plate, and a simple secondary operation severs the carrier strips thereby providing the necessary circuit isolation.

While there has been described what is at present considered to be the preferred embodiment of the invention, it will be understood that various modifications may be made therein, and it is intended to cover in the appended claims all such modifications as fall within the spirit and scope of the invention.

I claim:

1. An electrical connector assembly for terminating a ribbon cable having a group of electrical conductors disposed in parallel side by side relationship within a common sheath of insulation material, a first plurality of said conductors being active signal conductors and the remaining plurality being grounded shield conductors, said connector assembly comprising:

a group of spaced contact termination tabs electrically connected respectively to a corresponding plurality of signal conductors of said cable, each said contact termination tab being L-shaped in configuration with one leg portion of said tab being disposed substantially perpendicular to said ribbon cable and in electrical connection with a signal conductor thereof;

a common ground member electrically connected to the remaining plurality of said shield conductors;

said common ground member being spaced from said termination tabs; and a one piece molded dielectric housing means for encapsulating said common ground member leaving only a portion thereof exposed and encapsulating a portion of each said contact termination tabs including the electrical connections between said tabs and said signal conductors and encapsulating at least a portion of the ribbon cable including said common sheath of insulation material, to thereby provide an integral connector terminating said ribbon cable.

2. The connector assembly set forth in claim 1, wherein said contact termination tabs are aligned in a substantially parallel array disposed along one edge of said connector.

3. The connector assembly set forth in claim 1, wherein said cable extends laterally from said assembly from a side substantially adjacent to said array of contact termination tabs.

4. An electrical connector assembly for terminating a ribbon cable having a group of electrical conductors disposed in parallel side by side relationship within a common sheath of insulation material, a first plurality of said conductors being active signal conductors and the remaining plurality being grounded sheild conductors, said connector assembly comprising:

first and second groups of spaced contact termination tabs electrically connected respectively to a corresponding plurality of signal conductors of said cable;

a common ground member electrically connected to the remaining plurality of said shield conductors;

said common ground member being positioned between said first and second groups of contact termination tabs, and;

a one piece molded dielectric housing means for encapsulating said common ground member leaving only a portion thereof exposed and encapsulating a portion of each said contact termination tabs including the electrical connections between said tabs and said signal conductors and encapsulating at least a portion of the ribbon cable including said common sheath of insulation material, to thereby provide an integral connector terminating said ribbon cable.

5. A connector assembly for terminating a pair of ribbon cables, each cable having a group of electrical conductors disposed in parallel side-by-side relationship within a common sheath of insulation material, a first plurality of said conductors being active signal conductors and the remaining plurality being grounded shield conductors, said connector means comprising:

a first group of spaced contact termination tabs electrically connected respectively to a corresponding plurality of signal conductors of one of said cables;

a second group of spaced contact termination tabs electrically connected respectively to a corresponding pluraiity of signal conductors of the other of said cables;

a first common ground member electrically connected to said shield conductors of the first cable;

a second common ground member electrically connected to said shield conductors of the second cable; and a one piece molded dielectric housing means for encapsulating said first and second common ground members leaving only a portion thereof exposed and encapsulating a portion of each of said contact termination tabs including the electrical connections between said tabs and the signal conductors, and encapsulating at least a portion of each ribbon cable including said sheath of insulation material, to thereby provide an integral connector terminating said ribbon cables.

6. An electrical contact assembly for use in making a connector for use in terminating ribbon cable, said assembly comprising:

a one piece electrically conductive metal plate formed to provide active contact elements and a ground contact element, said active contact elements being spaced termination tabs aligned in a parallel array along an interconnection carrier strip, said ground contact element comprising an elongated ground member, said carrier strip also joining said active contact elements to said ground contact element and adapted to be severed from said tabs subsequent to mounting said contact assembly within a dielectric connector housing, whereby said tabs are separated from one another and said ground member.

7. The contact assembly set forth in claim 6, wherein each contact termination tab is generally L-shaped in configuration, with one leg of the L being disposed in a plane above the plane of the plate and generally parallel thereto and the second leg being disposed generally normal to the plane of the plate.

8. The contact assembly set forth in claim 6, wherein each said tab is connected to said carrier strip at the outside end of said first leg of each tab.

9. The contact assembly set forth in claim 6, wherein said ground member is disposed in a plane parallel to and below the plane of said plate.

10. A method for terminating an electrical ribbon cable in an integral connector, the cable having a group of insulated electrical conductors disposed in parallel side-by-side relationship, a first plurality of said conductors being signal conductors and the remaining plurality being shield conductors, comprising the steps of:

a. removing the insulation from selected ones of said circuit and shield conductors at a first end of said cable;

b. electrically connecting said signal conductors respectively to a plurality of corresponding contact termination tabs connected by a common interconnecting means;

c. electrically connecting each shield conductor to a common ground member;

d. integrally molding said conductors and said common ground member in a dielectric material while leaving exposed the common interconnecting means and at least a portion of said ground member; and e. removing the common interconnecting means so that each tab is electrically connected only to its associated signal conductor to thereby terminate said electrical ribbon cable with a connector having a plurality of exposed contact termination tabs in separate electrical connection with a corresponding plurality of signal conductors in said cable, and said connector having an exposed common ground member interconnecting said shield conductors.

11. A method for terminating an electrical ribbon cable in an integral connector, the cable having a group of insulated electrical conductors disposed in parallel side-by-side relationship, a first plurality of said conductors being signal conductors and the remaining plurality being shield conductors, comprising the steps of:

plating a plurality of termination tabs with a highly conductive material;

removing the insulation from selected ones of said circuit and shield conductors at a first end of said cable;

electrically connecting said signal conductors respectively to a plurality of corresponding contact termination tabs connected by a common interconnecting means;

electrically connecting each shield conductor to a common ground member;

encapsulating said conductors and said common ground member in a dielectric material while leaving exposed the common interconnecting means and at least a portion of said ground member; and, removing the common interconnecting means so that each tab is electrically connected only to its associated signal conductor thereby to terminate said electrical ribbon cable with a connector having a plurality of exposed contact termination tabs independently electrically connected to a corresponding plurality of signal conductors in said cable, and an exposed common ground member interconnecting said shield conductors.

12. The method set forth in claim 10, wherein the electrial connection of said signal and shield conductors is provided by soldering said conductors to the respective contact termination tabs and common ground member.

13. The method set forth in claim 10, wherein said dielectric material extends over an insulated portion of the cable to thereby assure that said signal and shield conductors are maintained in spaced relationship in said connector and provide a strain relief for the electrical connections between said conductors and the respective ground member and termination tabs.

14. A method for terminating a pair of electrical ribbon cables in an integral connector, each cable having a group of insulated electrical conductors disposed in parallel side-by-side relationship with a first plurality of said conductors being signal conductors and the remaining plurality being shield conductors, comprising the steps of:

a. removing the insulation from certain of said circuit and shield conductors at a first end of each of said cables;

b. electrically connecting said certain signal conductors of one of said cables respectively to a plurality of corresponding first set of contact termination tabs connected by a first common interconnecting means;

c. electrically connecting each said certain shield conductor of said one cable to a first common ground member;

d. electrically connecting said certain signal conductors of the other cable respectively to a plurality of corresponding contact termination tabs connected by a second common interconnecting means;

e. electrically connecting each said certain shield conductor of the other cable to a second common ground member;

f. encapsulating each of said certain circuit and shield conductors and common ground members and a portion of said contact termination tabs in an electrically insulating material while leaving exposed the first and second common interconnecting means and at least a portion of said first and second common ground members; and g. removing said first and second common interconnecting means so that each tab is electrically connected only to its associated signal conductor, to thereby terminate said electrical ribbon cables with a connector having a plurality of exposed contact termination tabs independently electrically connected to a corresponding plurality of signal conductors in said cables, and insulated common ground members interconnecting said shield conductors.

15. The method set forth in claim 14 wherein said first and second ground members are interconnected.

16. The method set forth in claim 14, wherein said first array of contact termination tabs is laterally spaced from said second array of contact termination tabs.

17. The method set forth in claim 14, wherein said first and second common ground members are disposed between said arrays of contact termination tabs of said first and second cables.

* * * * *